United States Patent [19]

Propst et al.

[11] 4,356,674

[45] Nov. 2, 1982

[54] FREE-STANDING SPACE DIVIDER ASSEMBLY WITH ACOUSTIC UPPER END BORDER

[75] Inventors: Robert L. Propst, Bellvue, Wash.; Michael A. Wodka, Ypsilanti; Ronald R. Hodges, Grandville, both of Mich.

[73] Assignee: Herman Miller, Inc., Zeeland, Mich.

[21] Appl. No.: 135,244

[22] Filed: Mar. 31, 1980

[51] Int. Cl.[3] ..... E04B 1/99; E04B 2/74

[52] U.S. Cl. ..... 52/242

[58] Field of Search ..... 52/144, 241, 242, 239, 52/238

[56] References Cited

U.S. PATENT DOCUMENTS

| | | | |
|---|---|---|---|
| 1,998,688 | 4/1935 | Robinson | 52/241 |
| 3,255,563 | 6/1966 | Sauer | 52/242 |
| 3,386,216 | 6/1968 | Zwickert | 52/242 |
| 3,537,217 | 11/1970 | Lickliter | 52/241 |
| 3,934,382 | 1/1976 | Gartung | 52/241 |

FOREIGN PATENT DOCUMENTS

| | | | |
|---|---|---|---|
| 251840 | 1/1967 | Fed. Rep. of Germany | 52/241 |
| 2011643 | 3/1970 | Fed. Rep. of Germany | 52/241 |

*Primary Examiner*—John E. Murtagh

*Attorney, Agent, or Firm*—Olsen and Stephenson

[57] ABSTRACT

A space divider assembly for an enclosure having a floor and a ceiling. The space divider assembly consists of a plurality of upright, free-standing, floor-supported panels arranged end to end and a plurality of border members secured to each other and to said panels so as to project upwardly from the panels and form a border at the upper ends of the panels. The border members are shaped at their upper ends to form a container for sound absorbing material which substantially fills the container and provides for sound separation of the areas of the enclosure on opposite sides of the panels.

12 Claims, 11 Drawing Figures

FREE-STANDING SPACE DIVIDER ASSEMBLY WITH ACOUSTIC UPPER END BORDER

BACKGROUND OF THE INVENTION

The modular office system, illustrated in Propst Pat. Nos. 3,418,765 and 3,517,467, solved a wide range of problems in the general office facility enabling the creation of highly functional, dynamic open plan areas. However, there is a need for fully private space enclosures in today's office environment based on the desire for acoustic privacy and for security. There is a need in modular office systems for the ability to communicate in complete confidence on matters such as hiring, firing, personnel reviews, financial policies, etc., and there is a need to selectively secure areas from indiscriminate traffic such as in the cases of confidential filing rooms, advance research, etc. The real challenge is to meet these needs in a way superior to demountable partitions and built drywalls.

Both the demountable partitions and the built drywalls have serious deficiencies in solving the needs of a dynamic organization subject to frequent change. Drywall, while initially the least expensive method of obtaining full privacy, is up to 100 percent lost in the first move. Moreover, true acoustic privacy is not obtained by basic drywall construction. Acoustic upgrading of the cavities between studs and of the ceiling path above must be implemented before true speech privacy is attained. Furthermore, standard drywall construction, while looking substantial, will not safely support wall-hung components; structural reinforcing is required.

Demountable partitions are initially expensive and have approximately a 10 percent loss in material in the first and subsequent moves. While the panels and connective devices are modular, the electrification of the systems is still conventional hard wiring which is expensive to modify in the first move. In acoustic performance, demountables are generally inferior to drywalls. The piece-part nature of demountable hardware (connective devices, base covers, etc.) cause many acoustic leaks which negate the performance of the best panels. Further, demountables are dependent on the ceiling for stability. Lightweight suspended ceilings vary in type and module size so greatly that the interface of the partition module to the ceiling is difficult and awkward. In the first and subsequent moves, the ceiling is often damaged. Dependence on these lightweight ceilings for stability limits the use of wall-hung components and significant problems are created by variable ceiling heights. The efficiency of carrying finished or partially finished inventory is difficult because the vertical panel size is not determined until order entry. This causes the industry to be "to order" special fabricators resulting in small orders becoming exorbitantly expensive to produce.

The object of this invention is to provide a space divider assembly with full privacy capability.

SUMMARY OF THE INVENTION

The space divider assembly of this invention consists of a plurality of upright, floor-supported panels arranged end to end and connected by joints which are of well-known construction illustrated in the aforementioned Propst U.S. Pat. No. 3,517,467. Upward border extensions of the panels are provided by securing a plurality of border members to each other and to the panels. Brackets are provided at the joints for supporting the ends of the border members so that the border members can be adjustably moved up and down relative to the panels. The upper ends of the border members support and conceal sound-absorbing material which is adjacent to and spaced from the ceiling and is for the purpose of attenuating acoustical energy and improving sound privacy across the panels. The space divider assembly is freed from dependence on the architecture and attains speech privacy across a panel run without the necessity for the ceiling. Because there is less interface with the ceiling architecture, problems with wavy, inclined, or nonparallel surfaces are reduced.

Further objects, features and advantages of the invention will become apparent from a consideration of the following specification, the appended claims, and the accompanying drawing in which:

Figure 1:
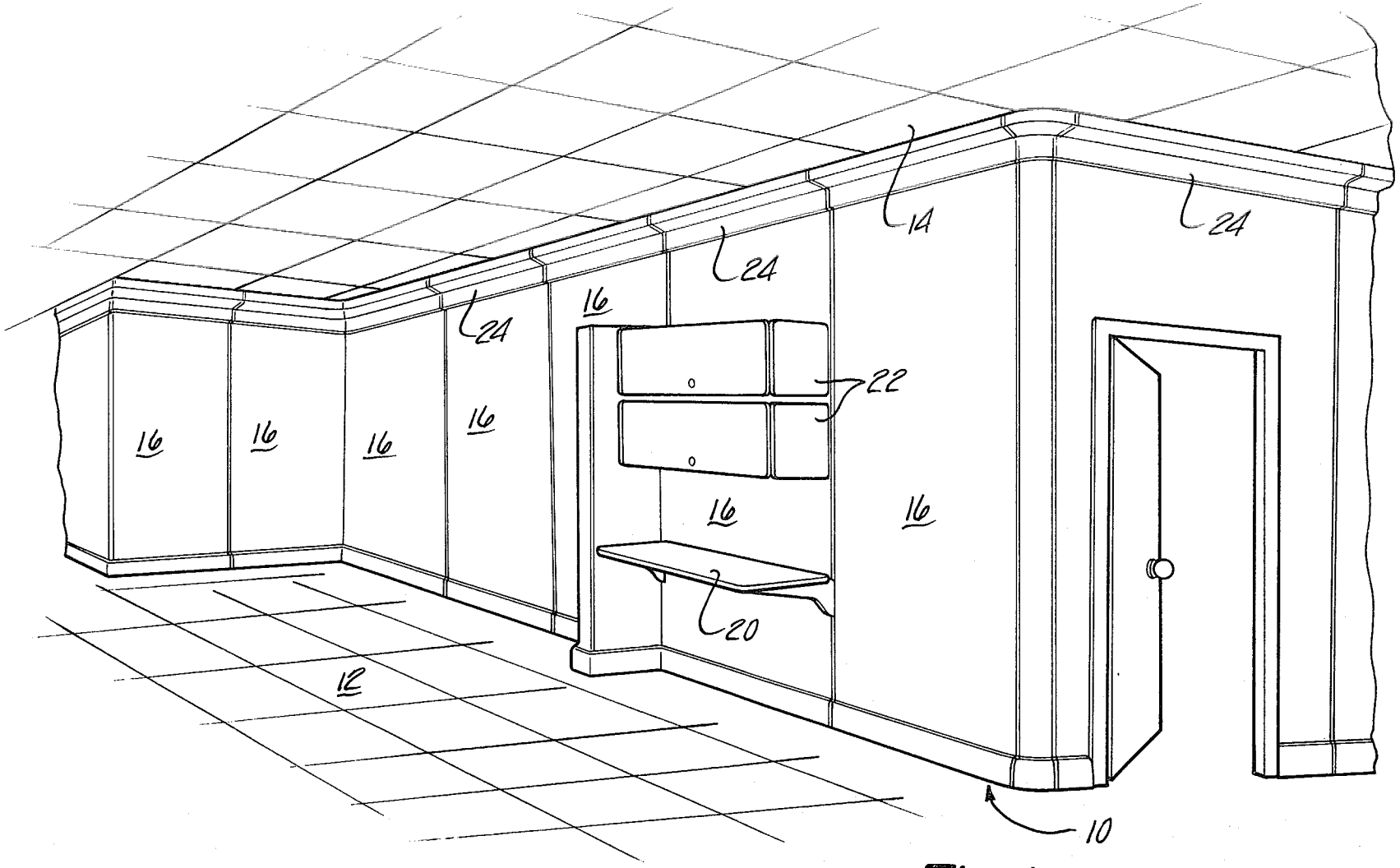
FIG. 1 is a perspective view of the space divider assembly of this invention.

With reference to the drawing, the space divider assembly of this invention, indicated generally at 10, is illustrated in FIG. 1 in an enclosure having a floor 12 and a ceiling 14. The space divider assembly 10 consists of a plurality of upright, free-standing floor-supported panels 16 which are arranged end to end and connected by joint assemblies 18 (FIG. 3) of known construction illustrated in the aforementioned Propst U.S. Pat. No. 3,517,467. The joints 18 have the capability for supporting various furniture elements on the panels 16 such as the shelf 20 and the storage cabinets 22 illustrated in FIG. 1. At their upper ends, the panels 16 support a plurality of border members 24 which are arranged end to end and are adjustably supported on the panels 16 for up and down movement. The panels are closely adjacent the ceiling (spaced one-half inch or less) but are spaced from the ceiling 14 and are totally independent in a structural sense from the ceiling 14.

Figure 2:
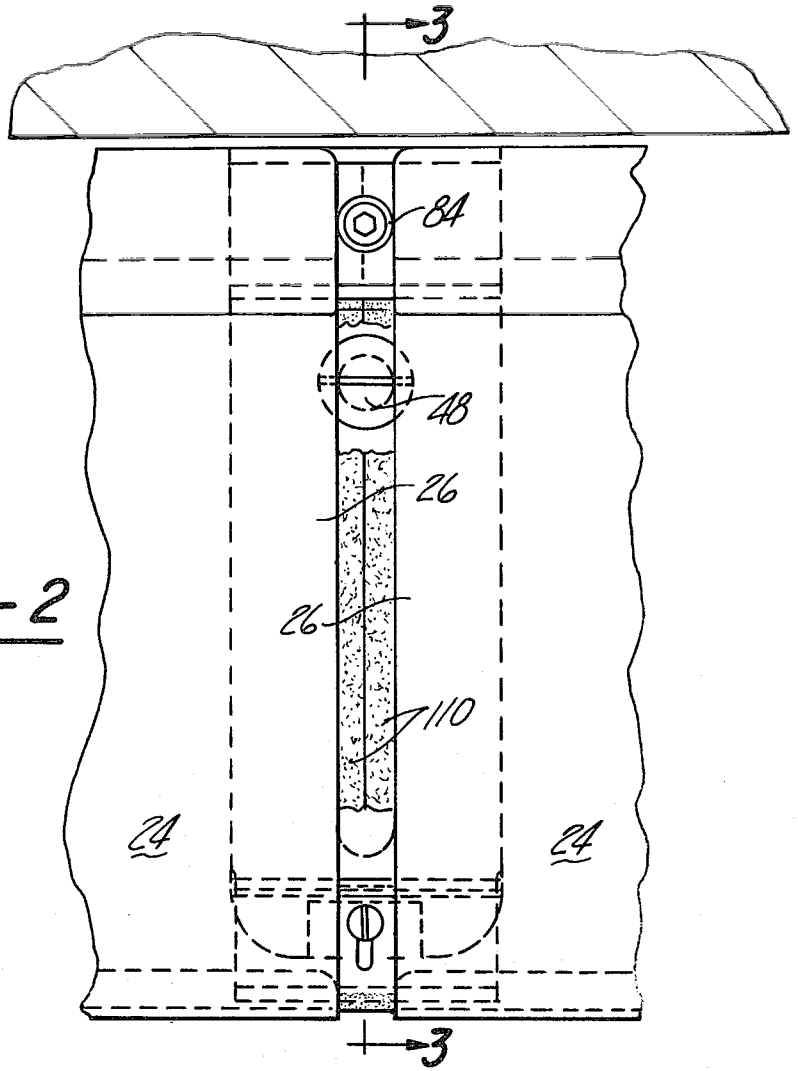
FIG. 2 is a fragmentary elevational view of portions of the adjacent ends of adjacent panels in a preferred form of the assembly of this invention.
Figure 3:
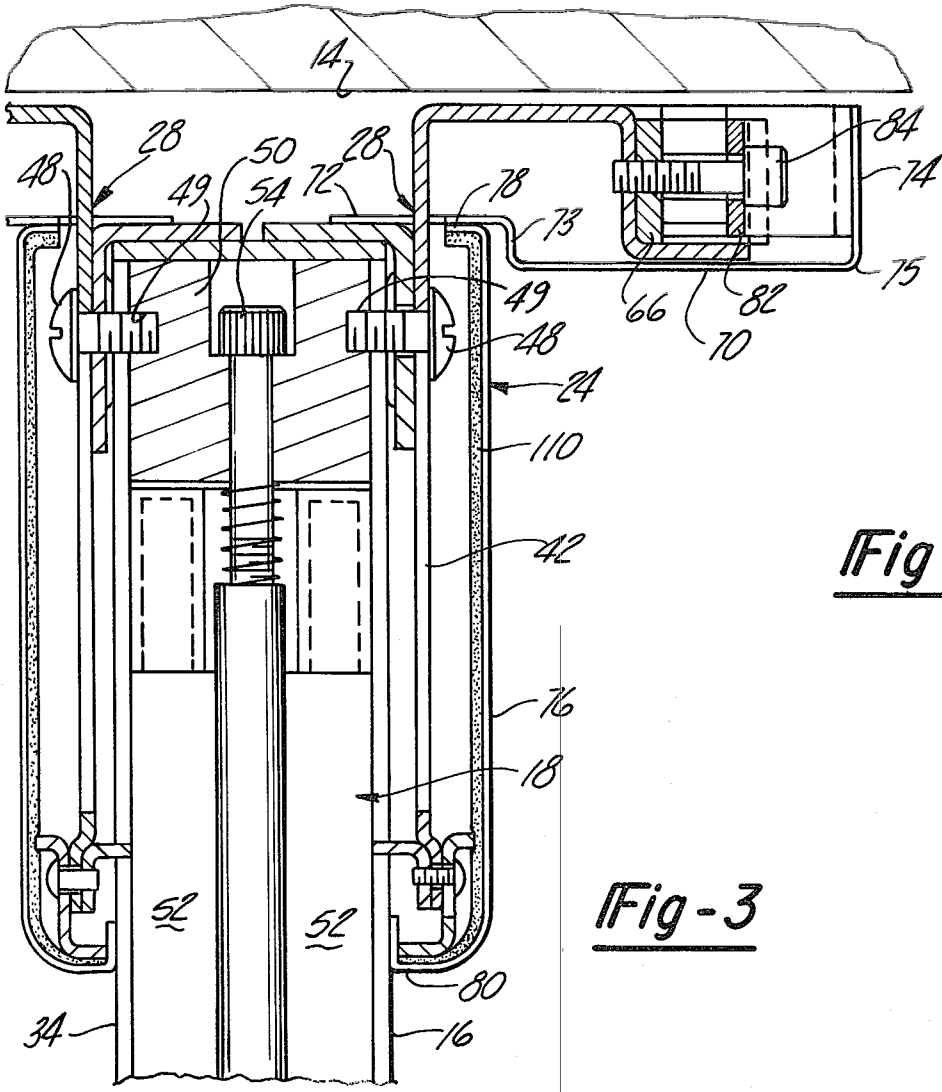
FIG. 3 is a transverse sectional view of the structure shown in FIG. 2, as seen from the line 3—3 in FIG. 2.
Figures 7, 8:
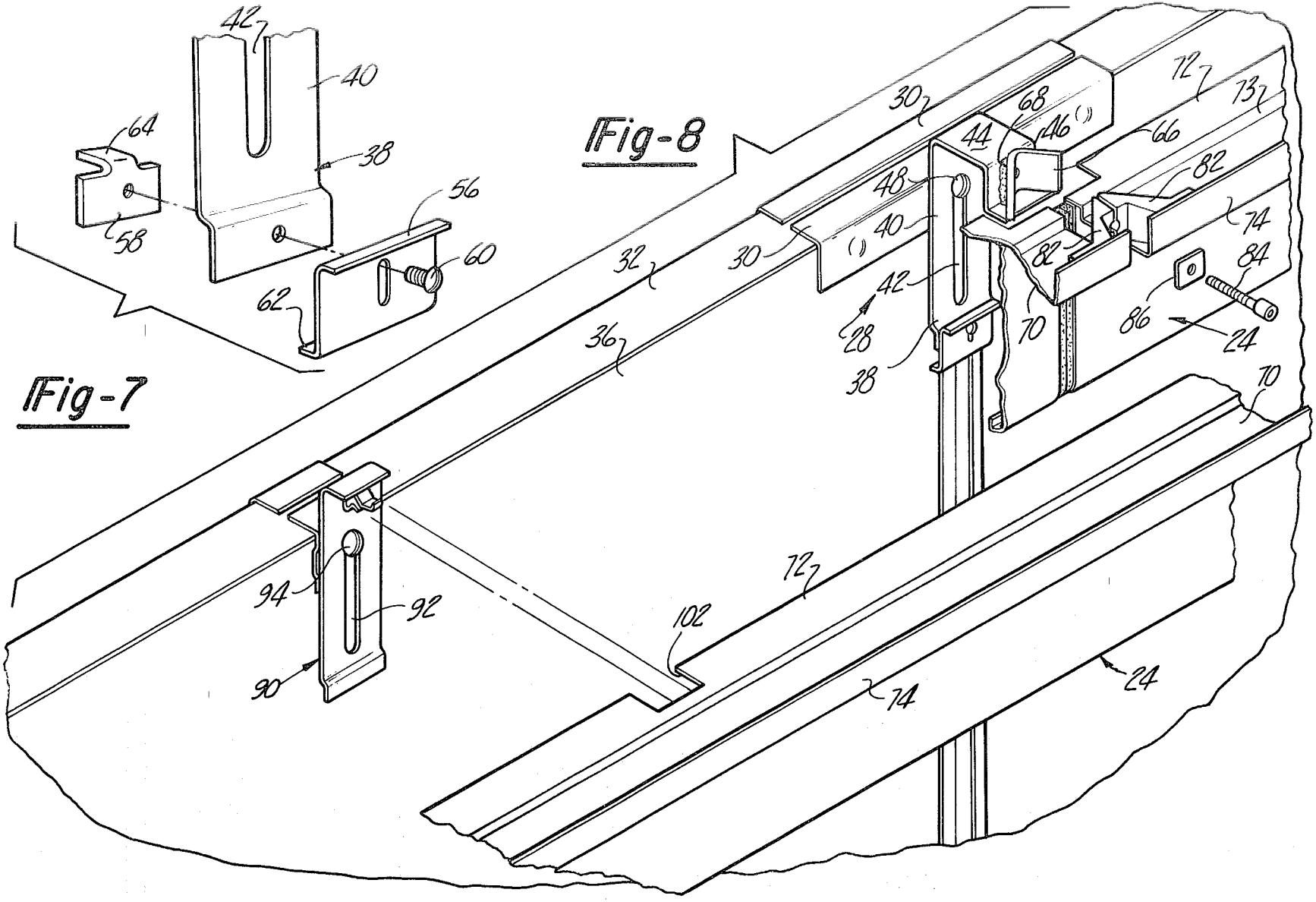
FIG. 7 is an exploded perspective view of the lower portion of a mounting bracket for the border members in the assembly of this invention.
FIG. 8 is an exploded perspective view of a portion of the assembly of this invention illustrating the manner of mounting the border members on the panels.

As shown in FIGS. 2, 3, and 8, adjacent ends 26 of adjacent border members 24 are adjustably mounted on the adjacent panels 16 by means of a bracket assembly 28 that is mounted on the joint assembly 18 that connects the adjacent panel members 16. The bracket assembly 28 consists of a pair of connecting angle straps 30 that are secured to the top 32 and opposite sides 34 and 36 of the panels 16. The assembly 28 also includes a bracket member 38 having an upright body portion 40 provided with a slot 42, an upper outwardly extending flange portion 44 and an L-shape extension 46 on the outer end of the flange 44. A bolt 48 extends through the slot 42 into a threaded opening 49 in the draw block 50 in the joint assembly 18 which cooperates with wedge blocks 52 and a tie rod 54 to connect the adjacent ends of adjacent panels 16 and provide mounting structure on which furniture such as the shelf 20 and the cabinets 22 can be mounted. As shown in FIGS. 7 and 8, the bracket member 38 has a pair of stabilizing elements 56 and 58 secured by a screw 60 to its lower end portion. The element 56 has an inturned flange 62 which engages the panels 16 on opposite sides of the joint assembly 18 and the stabilizing member 58 has an inwardly extending projection 64 which is positioned between the adjacent ends of the adjacent panels 16.

A wedge member 66, of generally V-shape when viewed from above, is secured by welding 68 to the bracket flange extension 46 for a purpose to appear presently.

Figure 5:
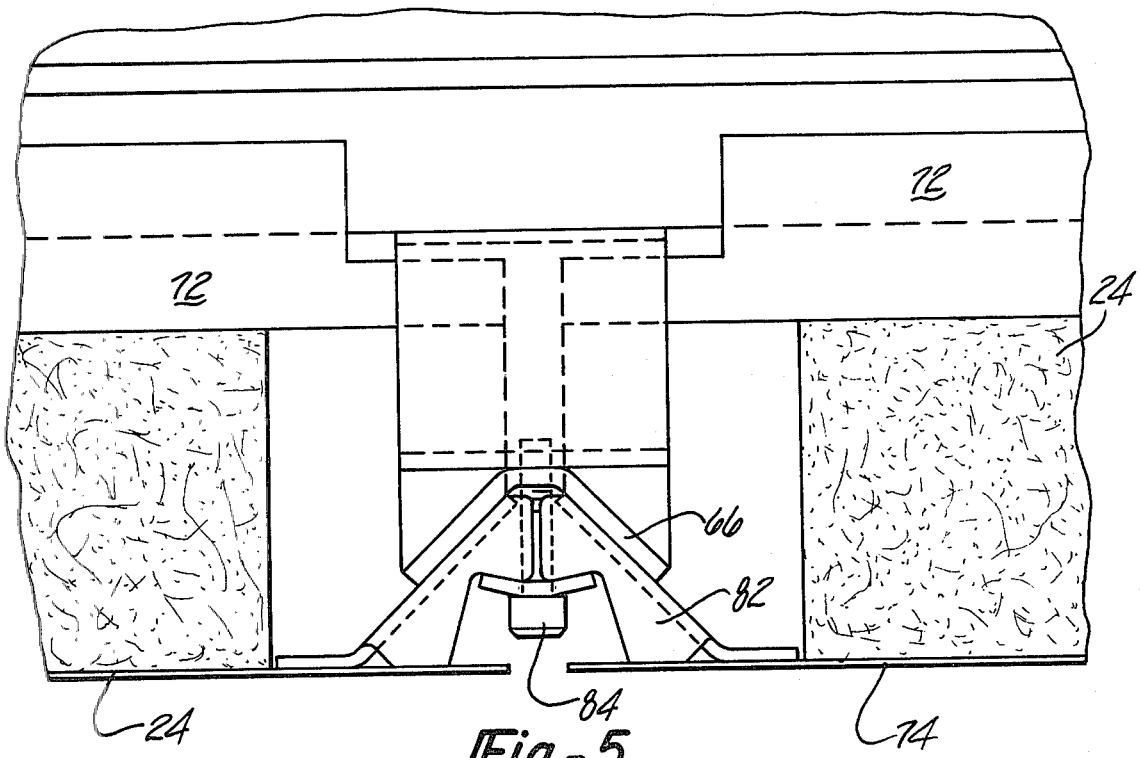
FIG. 5 is a fragmentary plan view of portions of the adjacent ends of adjacent panels in the assembly of this invention.

As best appears in FIGS. 3 and 8, the border member 24 consists of an upper generally horizontal shelf member 70 having an inwardly projecting generally horizontal mounting flange 72. The shelf 70 is bounded at its inner edge by a short upright flange 73 integral with the flange 72 and at its outer edge 75 buy a upright concealing flange 74. The border member 24 also includes a depending trim member 76 secured at its upper end 78 to the shelf member 70 at a position adajcent the flange 72. At its lower end, the trim member terminates in an inwardly extending flange 80 engaged with the panel 16. Half-wedge members 82 are secured to the ends of the shelf members 70 (FIGS. 5 and 8), the members 82 being shaped so that a pair of them can be telescoped into the wedge member 66 on the mounting bracket 28. The adjacent ends 26 of adjacent border members 24 are then secured to the bracket assembly 28 by inserting a bolt 84 through a washer 86 which engages the members 82, the bolt 84 extending into an opening 88 in the wedge member 66 and the mounting bracket flange 44 (FIG. 3).

Figure 4:
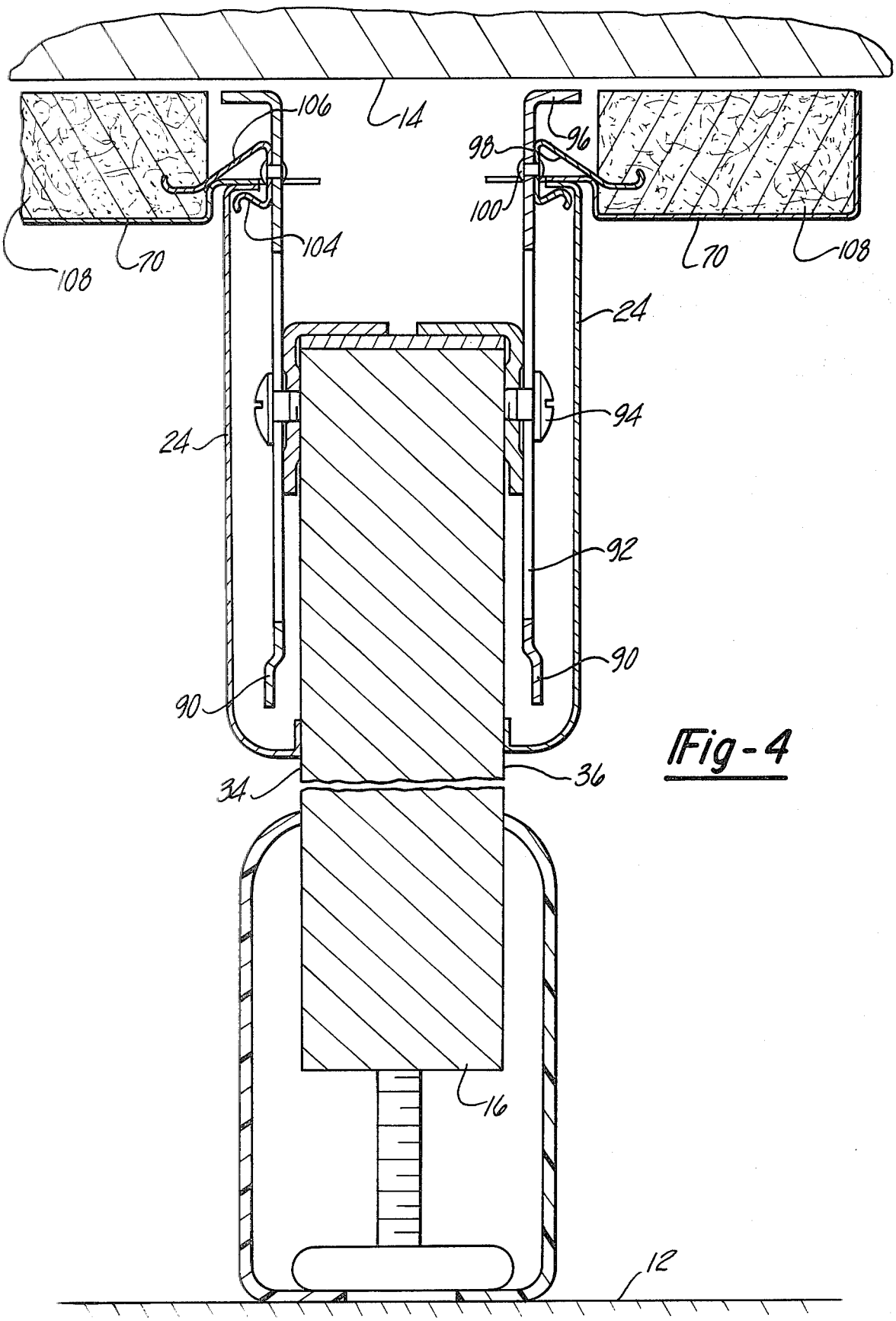
FIG. 4 is a transverse sectional view of the center portion of a panel in the space divider assembly of this invention.
Figure 6:
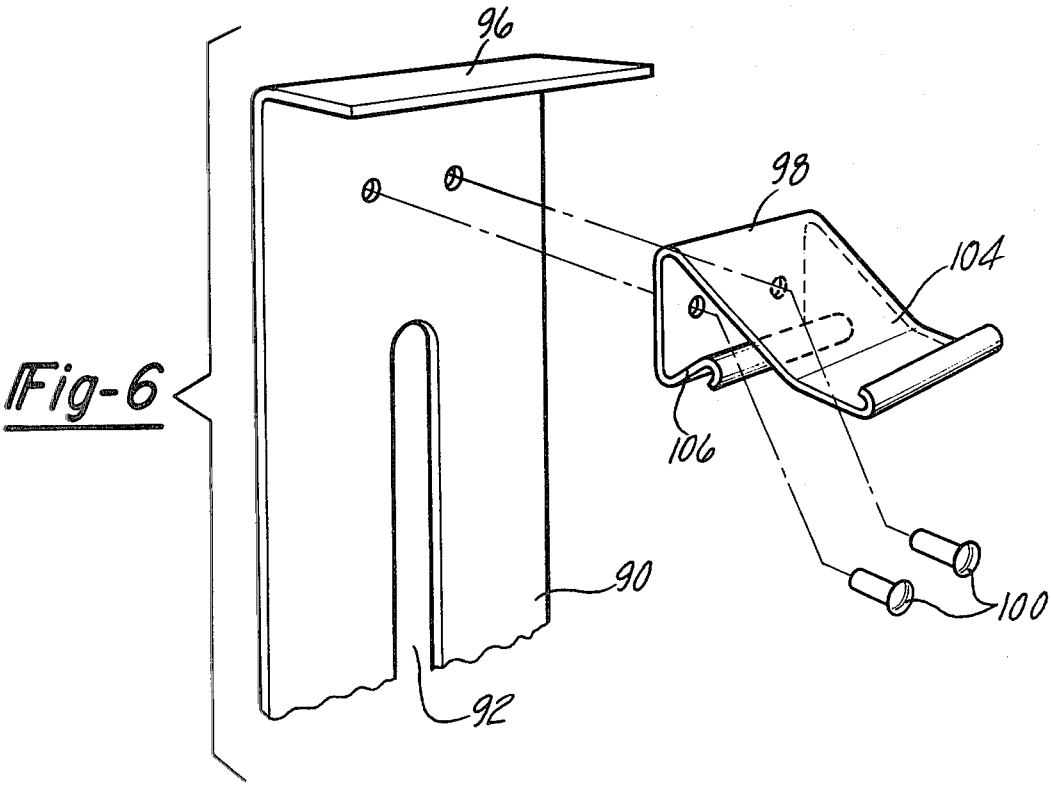
FIG. 6 is an exploded perspective view of the upper portion of a border member mounting bracket in the assembly of this invention.

It can thus be seen that the border members 24 are substantially co-extensive in length with the panels 16, the opposite ends of each border member 24 being secured to the bracket assemblies 28 mounted on the joint assemblies 18 at the ends of the corresponding panel. Intermediate its ends, each border member 24 is supported on a supplementary bracket 90 (FIGS. 4 and 8) similar to the bracket 38. The bracket 90 has an upright slot 92 and a bolt 94 extends through the slot 92 into the panel 16, as shown in FIG. 4, so as to mount the bracket 90 for adjustable up and down movement relative to the panel 16. At its upper end, the bracket member 90 has an outwardly extending flange 96 (FIGS. 4 and 8) positioned above a spring clip 98 which is secured to the bracket 90 by rivets 100 (FIG. 6). As shown in FIG. 8, the border member flange 72 has a notch 102 formed intermediate its ends at a position to allow the flange 72 to be moved into position between upper and lower leg portions 104 and 106, respectively, of the spring clip 98, with the flange 72 extending inwardly beyond the bracket member 90.

When a border member 24 is supported on the brackets 38 and 90 as described above, the shelf 70 and the flange 74 form a container means for a body 108 of sound absorbing material which is substantially fully concealed in the container means. The mounting bolts or screws 48 and 94 can be loosened and the border member 24 moved upwardly, the screws 48 and 94 moving in the slots 42 and 92, respectively, until the border members 24 are adjacent to, but spaced from, the ceiling 14 as illustrated in FIGS. 2, 3, and 4. The screws 48 and 94 are then tightened to retain the border members 24 in the elevated positions. This arrangement enables the provision of a relatively small number of standard height panels 16 which can be adapted to a wide variety of ceiling heights. A lining material 110 is illustrated as being provided on the inner surfaces of the border member trim sections 76 adjacent their ends. This material 110 can be a foamed plastic or rubber material or a felt material, the purpose being to provide for assembly of the border members 24 without any gaps between the adjacent ends 26 of adjacent border members 24 in uneven installation situations.

Figure 9:
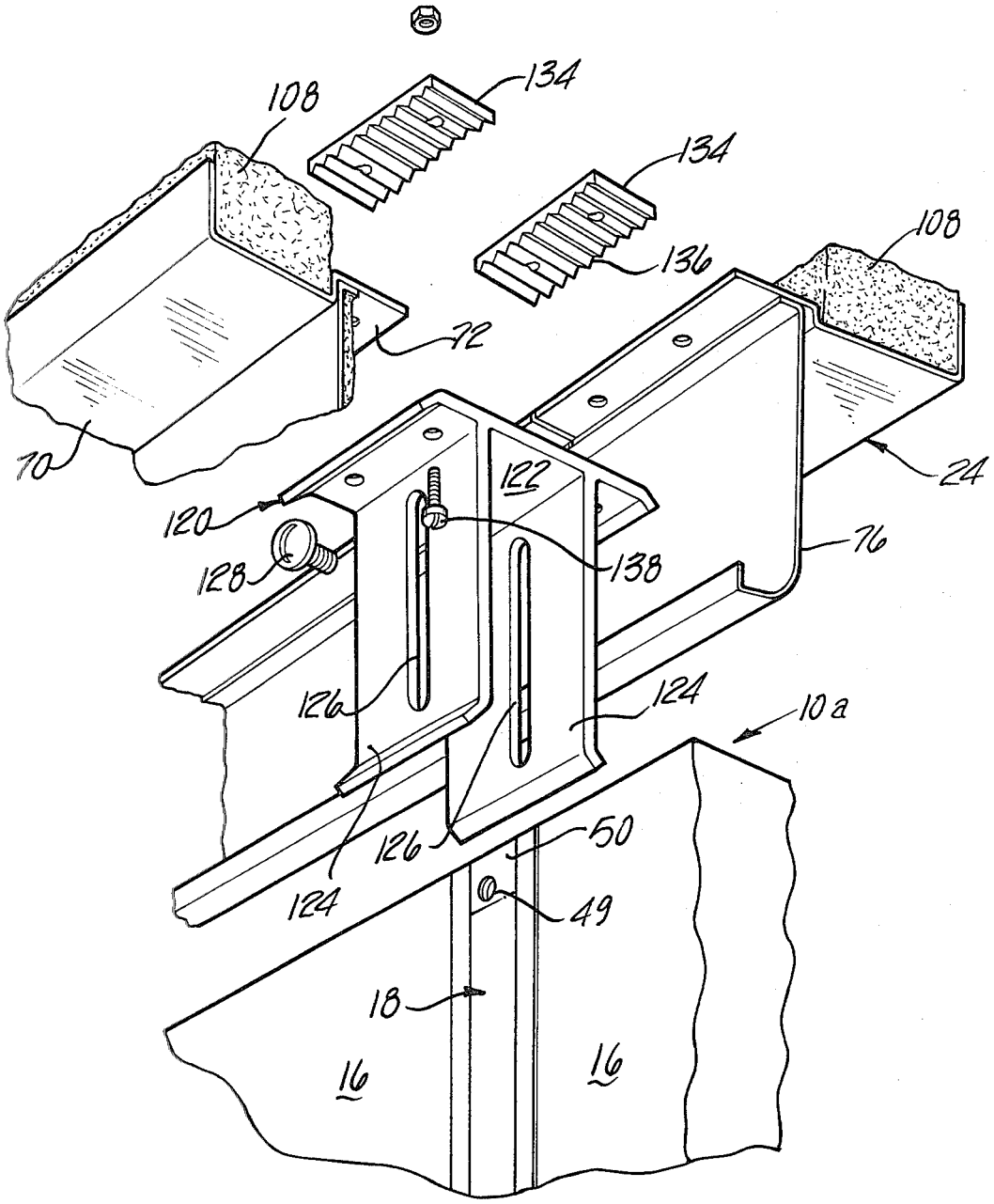
FIG. 9 is an exploded perspective view of a modified form of the assembly of this invention.
Figure 10:
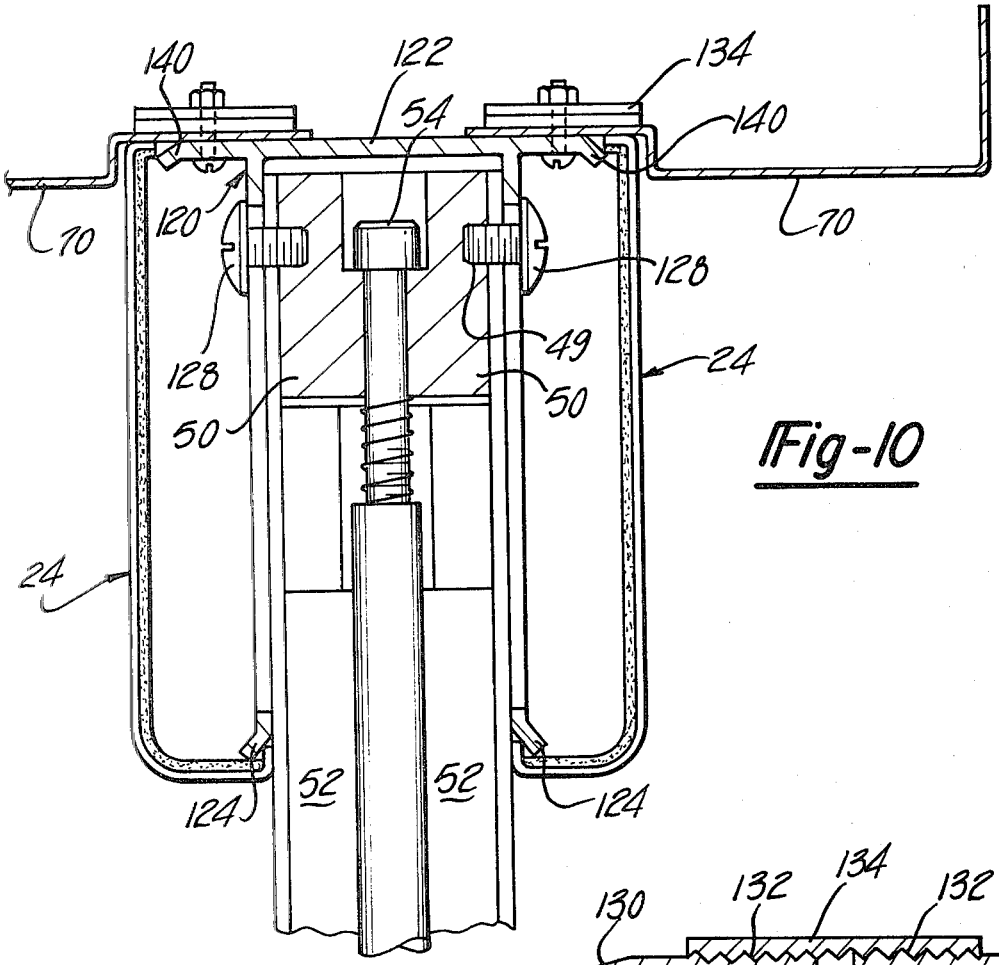
FIG. 10 is a fragmentary transverse sectional view of a portion of the modified form of the assembly of this invention.
Figure 11:
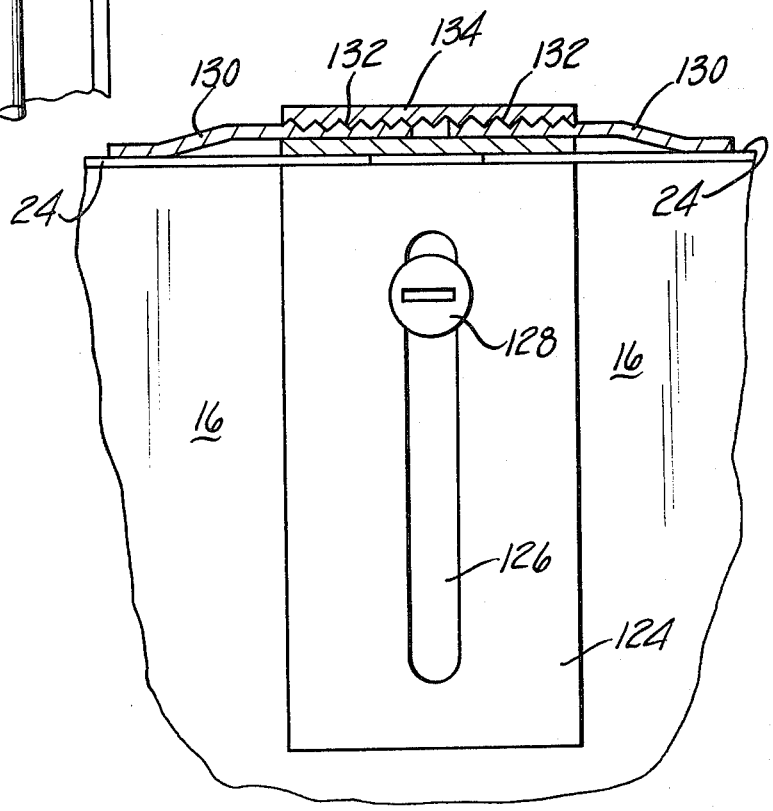
FIG. 11 is a fragmentary elevational view of the adjacent ends of adjacent panels in the modified form of the invention illustrated in FIGS. 9 and 10.

A modified form of the assembly 10, indicated generally at 10*a*, is illustrated in FIGS. 9, 10, and 11 which is substantially indentical to the assembly 10 except that the bracket assemblies 28 are replaced by bracket assemblies 120, each bracket assembly 120 replacing a pair of bracket assemblies 28 disposed on opposite sides of a panel assembly. Accordingly, only the bracket assembly 120 and its attachment to the border members 24 will be described in the embodiment 10*a*, like numerals in the embodiment 10*a* indicating like parts in the embodiment 10. The bracket 120 has a top body portion 122 which is generally horizontal and a pair of depending legs 124 having slots 126 through which mounting bolts 128 are extended into openings 49 in the draw block 50 in the joint assembly 18 between adjacent panels 16. The border members 24 are provided at their adjacent ends with attaching plates 130 having serrated upper surfaces 132. Clamping plates 134 having serrated upper surfaces 136 are secured by bolts 138 to the oppositely directed flanges 140 on the body member 122. The serrated surfaces 132 and 136 mesh so as to preclude relative movement of the border members 24. The assembly 10*a* can then be operated like the assembly 10 to provide a full privacy enclosure.

From the above description, it is seen that this invention provides an improved space divider assembly 10 which establishes structural stability in full privacy configurations. By virtue of the vertical adjustability of the border members 24, the assemblies 10 and 10*a* are adaptable to a variety of ceiling heights. The assemblies 10 and 10*a* provide for acoustic separation of opposite sides of the panels 16 without engagement of the assemblies with the ceiling 14 because sound waves are deflected off the ceiling into the sound absorbing material 108.

We claim:

1. A space divider assembly for an enclosure having a ceiling and a floor, said assembly comprising a plurality of upright floor-supported panels arranged end to end, means forming upward border extensions of said panels, said means comprising a plurality of border members secured to each other and to said panels so as to project upwardly and form a border at the upper ends of said panels which is spaced from and structurally independent of said ceiling, and upwardly facing sound absorbing material supported on said border members and spaced below said ceiling, means forming connecting joints between adjacent ones of said panels, bracket means secured to said joint means, said border members being of a length to extend between adjacent bracket means, and mounting means at said bracket means operable to secure adjacent ends of adjacent border members to said bracket means and to each other whereby to stabilize the end-to-end arrangement of said panels.

2. A space divider assembly as set forth in claim 1 wherein said mounting means comprises coacting interfitting means on said bracket means and the adjacent ends of said border members, and attachment means urging said interfitting means into attaching engagement.

3. A space divider assembly as set forth in claim 2 wherein said interfitting means comprises a generally V-shape member on said bracket means, half-wedge members on the adjacent ends of said border members movable into nesting engagement with said V-shape member and bolt means extending through said half-wedge members and said bracket means forcing said half-wedge members into engagement with said V-shape member.

4. A space divider assembly as set forth in claim 2 wherein said interfitting means consists of serrated surfaces some of which are fixed relative to said border member and others of which are fixed relative to said bracket means.

5. A space divider assembly as set forth in claim 1 wherein said bracket means comprises a bracket member mounted on said joint means for adjustable up and down movement, outwardly extending flange means on the upper end of said bracket member and connecting means on said flange means securing said border members to said bracket member.

6. A space divider assembly as set forth in claim 5 further including supplementary bracket members adjustably mounted on said panels intermediate said joint means and means mounting said border members intermediate the ends thereof to said supplementary bracket members.

7. A space divider assembly as set forth in claim 6 wherein said mounting means on said supplementary bracket members includes spring clip means having leg portions engageable with opposite top and bottom surfaces on said border members.

8. In a enclosure having a floor and a ceiling, a space divider assembly comprising a plurality of upright floor-supported panels arranged end to end, means forming upward border extensions of said panels, said means comprising a plurality of border members secured to each other and to said panels so as to project upwardly and form a border at the upper ends of said panels which is structurally independent of and spaced from said ceiling, said border members being shaped at the upper ends thereof to form container means located adjacent to and spaced below said ceiling, and sound absorbing material supported in and substantially filling said container means so as to be in a spaced relation with said ceiling, joint means between adjacent ends of adjacent ones of said panels and bracket members secured to said joint means and arranged in a supporting relation with said border members, each of said border members corresponding to one of said panels and being coextensive in length with said one panel, and means securing the ends of said border members to said bracket members and to each other whereby to stabilize the end-to-end arrangement of said panels.

9. The structure according to claim 8 wherein each of said bracket members has a body portion and a pair of depending spaced leg portions telescoped downwardly over one of said joint means and secured thereto.

10. The structure according to claim 9 further including flange means on the upper end of each of said bracket members, and connecting means securing said flange means to adjacent ends of adjacent ones of said border members.

11. The structure according to claim 8 wherein each of said border members is comprised of an upper container shelf portion having a generally horizontal mounting flange at its inner edge and an upright concealing flange at its outer edge, and a depending trim member secured at its upper end to said shelf portion intermediate said inner and outer edges and extending downwardly therefrom in a generally parallel relation with one of said panels.

12. The structure according to claim 11 wherein said trim member terminates at the lower end thereof in an inwardly extending flange engaged with said one panel.

* * * * *